US010273563B2

(12) United States Patent
Marya

(10) Patent No.: US 10,273,563 B2
(45) Date of Patent: Apr. 30, 2019

(54) MIXER FOR PRODUCING AND SOLIDIFYING AN ALLOY IN A SUBTERRANEAN RESERVOIR

(71) Applicant: Schlumberger Technology Corporation, Sugar Land, TX (US)

(72) Inventor: Manuel Marya, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/591,985

(22) Filed: May 10, 2017

(65) Prior Publication Data

US 2018/0327886 A1 Nov. 15, 2018

(51) Int. Cl.
*E21B 33/138* (2006.01)
*C22C 1/02* (2006.01)
(Continued)

(52) U.S. Cl.
CPC ..... *C22C 1/02* (2013.01); *B01F 3/1221* (2013.01); *B01F 3/1242* (2013.01); *B01F 3/1271* (2013.01); *B01F 3/14* (2013.01); *B01F 3/2071* (2013.01); *B01F 7/00341* (2013.01); *B01F 7/00391* (2013.01); *B01F 7/22* (2013.01); *B01F 7/24* (2013.01); *B01F 11/0068* (2013.01); *B01F 11/0266* (2013.01); *B01F 15/065* (2013.01); *B01F 15/066* (2013.01); *C22C 9/00* (2013.01); *C22C 11/06* (2013.01); *C22C 12/00* (2013.01); *C22C 13/00* (2013.01); *C22C 28/00* (2013.01); *E21B 27/04* (2013.01); *E21B 33/1204* (2013.01); *E21B 33/13* (2013.01); *E21B 33/138* (2013.01); *E21B 36/00* (2013.01); *B01F 2015/061* (2013.01); *B01F 2015/062* (2013.01);
(Continued)

(58) Field of Classification Search
CPC ..... C22C 12/00; E21B 7/061
See application file for complete search history.

(56) References Cited

U.S. PATENT DOCUMENTS 2,298,129 A 10/1942 Irons
4,015,981 A 4/1977 Rogova et al.
(Continued)

FOREIGN PATENT DOCUMENTS

WO 2016160616 A1 10/2016

OTHER PUBLICATIONS

International Search Report and Written Opinion issued in International Patent application PCT/US2018/031713, dated Nov. 8, 2018, 17 pages.

*Primary Examiner* — Zakiya W Bates

(57) ABSTRACT

A downhole tool includes a housing configured to be placed into a subterranean environment and a mixer disposed in the housing. The mixer includes a first inlet configured to receive a fusible metal or alloy component and a second inlet configured to receive a solid metal or semi-metal component. Additionally, the mixer includes a mixing chamber configured to mix the fusible metal or alloy component and the solid metal or semi-metal component to form a liquid or partially liquid alloy. Further, the mixer includes an outlet configured to discharge the liquid or partially liquid alloy into the subterranean environment. The liquid or partially liquid alloy is configured to harden into a solid alloy over time.

19 Claims, 11 Drawing Sheets

(51) Int. Cl.

| | |
|---|---|
| ***B01F 15/06*** | (2006.01) |
| ***B01F 3/14*** | (2006.01) |
| ***B01F 3/12*** | (2006.01) |
| ***B01F 7/00*** | (2006.01) |
| ***B01F 7/22*** | (2006.01) |
| ***B01F 7/24*** | (2006.01) |
| ***B01F 11/00*** | (2006.01) |
| ***B01F 11/02*** | (2006.01) |
| ***B01F 3/20*** | (2006.01) |
| ***C22C 12/00*** | (2006.01) |
| ***C22C 13/00*** | (2006.01) |
| ***C22C 28/00*** | (2006.01) |
| ***C22C 11/06*** | (2006.01) |
| ***C22C 9/00*** | (2006.01) |
| ***E21B 27/04*** | (2006.01) |
| ***E21B 36/00*** | (2006.01) |
| ***E21B 33/13*** | (2006.01) |
| ***E21B 33/12*** | (2006.01) |

(52) U.S. Cl.
CPC ..... *B01F 2215/0036* (2013.01); *B01F 2215/0044* (2013.01)

(56) References Cited

U.S. PATENT DOCUMENTS

| | | | | |
|---|---|---|---|---|
| 4,659,384 | A | 4/1987 | Daigo et al. | |
| 5,582,251 | A | 12/1996 | Bailey et al. | |
| 2006/0144591 | A1 | 7/2006 | Gonzalez et al. | |
| 2015/0224460 | A1 | 8/2015 | Banus | |
| 2018/0033509 | A1* | 2/2018 | Germanovich ..... | B65G 5/00 |

* cited by examiner

MIXER FOR PRODUCING AND SOLIDIFYING AN ALLOY IN A SUBTERRANEAN RESERVOIR

BACKGROUND

This disclosure relates to a mixer for producing and solidifying an alloy in a subterranean reservoir environment, including hydrocarbon oil and gas wells, geothermal wells, gas sequestration wells, waste disposal wells, mining pit holes, or the like.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Seals, especially elastomeric seals are used in a variety of downhole tools, tool strings, and applications for subterranean exploration, production, injection, and sequestration. Seals are broadly intended to block fluid flow in certain areas or elements of tools, thereby directly enabling control of well operations, thus choking, blocking, or preventing fluid flow to certain zones of a subterranean reservoir. Due to exposure to uncontrolled environmental fluids, the seals in subterranean reservoir environments may experience corrosive conditions that lead to gradual losses of their performance, or possibly failure, over time. In a subterranean reservoir environment, seals are most typically employed to hydraulically isolate an inner surface of the wellbore from an outer surface of the wellbore or, alternatively, to isolate subterranean reservoirs from one another, such as during zonal isolation applications. In typical use cases, as may be appreciated, elastomeric seals may have one or several deficiencies. For example, the elastomeric seals may be subject to corrosion or chemical degradation (e.g.) by subterranean reservoir fluids. Because the elastomeric seals may be customized in specific sizes for each application, including various bore diameters, the elastomeric seals may be expensive to produce and/or may inconveniently introduce non-productive time if the elastomeric seals are not immediately available to well sites. Moreover, "chemically responsive" elastomeric seals, as typically found in completion swell packers, may take considerable time to achieve a structurally sound operating state or may improperly swell and improperly isolate the flow of an undesirable fluid. Low-cost and common elastomeric seals, such as seals made of nitriles (NBR) and hydrogenated nitriles (HNBR), are well-known to be subject to rapid chemical degradation in sour environments (i.e., environments having sour gas, $H_2S$). Other low-cost and common elastomeric seals such as of a fluoroelastomer type (FKM, also referred as Viton™) may experience less environmental compatibility issues with subterranean reservoir fluids, but are undesirably more prone to degradation by the high-pH completion brines that may be employed down a well. In some cases, the wellbore may have a small cross sectional area (e.g., choke along production tubing), thereby offering a challenge for elastomeric seals to maneuver pass the choke. It is also not uncommon for elastomeric seals to encounter rough and/or corroded surfaces such as open-hole geological formations or corroded cased hole steel surfaces, against which it may be particularly difficult to achieve high permanent sealing pressures. These constraints, among others, hinder the utilization and/or useful operating lives of elastomeric seals within the subterranean reservoir environments.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one example, a downhole tool includes a housing configured to be placed into a subterranean environment and a mixer disposed in the housing. The mixer includes a first inlet configured to receive a fusible metal or alloy component and a second inlet configured to receive a solid metal or semi-metal component. Additionally, the mixer includes a mixing chamber configured to mix the fusible metal or alloy component and the solid metal or semi-metal component to form a liquid or partially liquid alloy. Further, the mixer includes an outlet configured to discharge the liquid or partially liquid alloy into the subterranean environment. The liquid or partially liquid alloy is configured to harden into a solid alloy over time (e.g., to block fluid circulation or undesirable fluid circulation).

In another example, a method includes placing a downhole tool into a subterranean environment and producing a liquid or partially liquid alloy via a mixer of the downhole tool. The liquid or partially liquid alloy is produced by contacting a liquid fusible metal or alloy component with a solid metal or semi-metal component within the mixer. Additionally, the liquid or partially liquid alloy is produced by mixing the liquid fusible metal or alloy component and the solid metal or semi-metal component. Further, the liquid metal component material and the solid metal or semi-metal component react via metallurgical reactions that produce the liquid or partially liquid alloy. The liquid or partially liquid alloy is discharged into the subterranean environment and is configured to harden into a solid alloy over time (e.g., to block fluid circulation or undesirable fluid circulation).

In a further example, a downhole tool includes a housing configured to be placed into a subterranean environment and a mixer disposed in the housing. The mixer includes a first inlet configured to receive a fusible metal or alloy component. The fusible metal or alloy component includes an onset of melting temperature that is within a threshold range of a temperature of the subterranean environment. Additionally, the mixer includes a second inlet configured to receive a solid metal or semi-metal component. The solid metal or semi-metal component includes a particle size that is within a particle size threshold. The mixer additionally includes a mixing chamber configured to mix the fusible metal or alloy component and the solid metal or semi-metal component to form a liquid or partially liquid alloy. The liquid or partially liquid alloy is a product of intermetallic reactions between a mixture of the fusible metal or alloy component and the solid metal or semi-metal component. Further, a specific gravity of the liquid or partially liquid alloy and a specific gravity of the mixture of the fusible metal or alloy component and the solid metal or semi-metal component are within 20% from one another. The mixer further includes an outlet configured to discharge the liquid or partially liquid alloy into the subterranean environment. The liquid or partially liquid alloy is configured to harden into a solid alloy over time to block fluid circulation (e.g., to block fluid circulation or undesirable fluid circulation).

Technical effects of the present disclosure include the production and solidification of an alloy product within a subterranean environment, subterranean reservoir environment, and/or wellbore. The alloy product may be an alloy with intermetallic compounds, such as an amalgam or an amalgam-like alloy that may rapidly solidify or harden to seal various subterranean elements, such as tubing and casing components, tubing and casing components having cracks and/or corrosion holes, connection leaks, casting-to-tubing spaces (e.g., above thread connections), tool ports, tool internal passageways no longer functionally in need, and porous geological formations (e.g., especially when producing undesirable fluids such as water in high flow rates or water cuts). The alloy product typically possesses a crystalline structure that leads to an increased onset of melting or solid thermal stability range compared to reactants. The alloy product may be produced by a mixer that is either integral or part of a downhole tool or tool string, such that the alloy product is easily prepared and applied in proximity to the various subterranean elements. To produce the alloy product, the mixer may include a mixing chamber that combines a fusible metal component or reactant and a solid metal or semi-metal component or reactant. In some embodiments, more than two reactants are used to seal the various subterranean elements. When in contact, the fusible metal component or reactant and the solid metal or semi-metal component or reactant react metallurgically to form the alloy product in a liquid or partially liquid phase, which may then be applied to seal the various subterranean elements as the alloy product solidifies or hardens over time.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
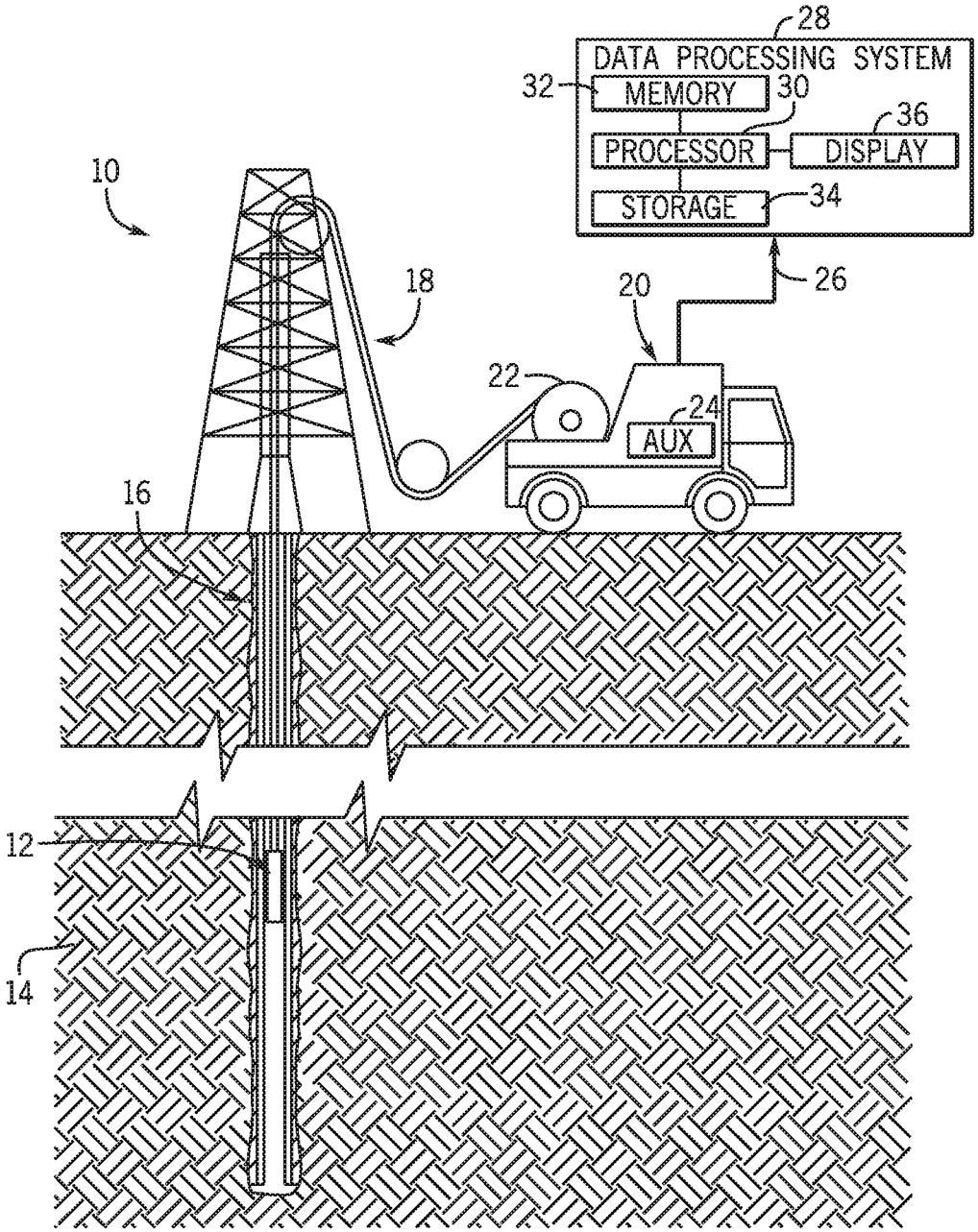
FIG. 1 is a schematic diagram of a drilling system that includes a downhole tool to produce a liquid or partially liquid alloy product for sealing various subterranean elements, in accordance with an embodiment.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Different downhole tools, and combinations of different downhole tools assembled to form a downhole tool string, may be used for performing a variety of tasks in a subterranean environment. The subterranean environment may include a subterranean reservoir environment, a downhole environment, a wellbore environment, or another suitable environment. For example, a single downhole tool may include a mixer for producing and solidifying an alloy product, such as an alloy with intermetallic compounds, within a subterranean reservoir environment. The alloy with intermetallic compounds may be an amalgam, or an amalgam-like alloy. In the downhole tool string, the mixer may be coupled to a heater to provide thermal energy for melting reactants that form the alloy with intermetallic compounds, which are then uniformly mixed within the mixer. The alloy product may be employed for sealing various subterranean elements, such as tubing and casing components, tubing and casing components having cracks and/or corrosion holes, connection leaks, casting-to-tubing spaces (e.g., above thread connections), tool ports, tool internal passageways no longer functionally in need, and porous geological formations (e.g., especially when producing undesirable fluids such as water in high flow rates or water cuts). Indeed, because the mixer may produce alloy products such as an alloy with intermetallic compounds, particularly, an amalgam or an amalgam-like alloy that may be subsequently solidified or hardened within the subterranean reservoir environment, the mixer may be readily utilized to produce seals in subterranean reservoir environments for a variety of tasks. The seals produced by the mixer described herein may be made from corrosion-resistant alloys that survive subterranean, corrosive environments much more reliably than the elastomeric seals described above. Indeed, producing the seal in the subterranean reservoir environment (e.g., in-situ) may overcome many challenges faced by elastomeric seals, thus advantageously creating novel opportunities for zone isolation in contrast to common elastomeric seals (as found in packers, bridge plugs, and the like). Likewise, producing the seal downhole in the subterranean reservoir in proximity to the tool or zone to be treated may also offer advantages over polymer-containing sealing fluids, normally pumped down the subterranean reservoir to seal off zones, for instance, to reduce water production in hydrocarbon oil and gas wells.

The mixer produces the alloy products by bringing reactants into physical proximity to promote a thermally-activated diffusion driven by chemical potentials between the reactants. The reactants may be a fusible metal component and a solid metal or semi-metal component. Additionally, it is to be understood that the solid metal or semi-metal component may also include alloys of more than one metal or semi-metal. In some embodiments, the fusible metal component reactant may be one or more metals that are melted in the subterranean reservoir environment. The fusible metal component may be a commercially pure metal (e.g., metal with non-purposely included chemistries or impurities, or an alloy made of more than a single chemical element). The solid metal or semi-metal component comprises at least one chemical element, usually between two and six chemical elements. In some embodiments, the solid metal or semi-metal component also has a higher thermal onset of melting (i.e. greater melting temperature) than pure metals and/or the fusible metal component. Thus, the metal or semi-metal component may be solid when entering the mixer. In this disclosure, a solid metal designates a pure metal or alloy, including amalgam-like alloys. A semi-metal is defined as a chemical element, or a grouping of chemical elements in stoichiometric or non-stoichiometric ratios, thereby forming intermetallic compounds with properties similar and midway between metals and non-metals. Useful semi-metals include antimony (Sb), among other semi-metals such as silicon (Si) or Germanium (Ge), as discussed in more detail below.

After melting, a resulting liquid fusible metal component may then be mixed with the solid metal or semi-metal component within the mixer before being deployed in the subterranean reservoir environment as a liquid or partially liquid alloy product. Over time, the liquid or partially liquid alloy product may be designed such that the liquid or partially liquid alloy product solidifies where a seal is desirably formed to block (e.g., inhibit, reduce, modify) circulation of fluid. In some embodiments, the fluid is desirably blocked from flowing. Accordingly, it is now recognized that liquid or partially liquid alloy products including intermetallic compounds formed in-situ rapidly crystallize in the subterranean reservoir environment due to time-dependent diffusion-controlled transformations.

To produce and solidify the alloy product, the mixer may employ various features, equipment, and/or tools. The various features, equipment, and/or tools may be internal or external to a housing surrounding the mixer. For example, the mixer may include a grinder to fragment the reactants into smaller particles or particulates, a heater or heat source to promote melting (e.g., liquefaction) of the reactants, a chiller to accelerate cooling of the liquid or partially liquid alloy product into a solid alloy product, a shaker to agitate the reactants for improved and potentially faster metallurgical reactions, and/or other features that perform beneficial tasks within the mixer. In some embodiments, the shaker may utilize mechanical, electrical, and/or sonic and ultrasonic technologies, particularly piezoelectric technologies, and any combination of these technologies.

With the foregoing mind, FIG. 1 illustrates a well-logging system 10 that may employ the systems and methods of this disclosure. The well-logging system 10 may be used to convey a downhole tool 12 through a geological formation 14 via a wellbore 16. In the example of FIG. 1, the downhole tool 12 is conveyed on a cable 18 via a logging winch system (e.g., vehicle) 20. Although the logging winch system 20 is schematically shown in FIG. 1 as a mobile logging winch system carried by a truck, the logging winch system 20 may be substantially fixed (e.g., a long-term installation that is substantially permanent or modular). Any suitable cable 18 for well logging may be used. The cable 18 may be spooled and unspooled on a drum 22 and an auxiliary power source 24 may provide energy to the logging winch system 20 and/or the downhole tool 12.

Moreover, while the downhole tool 12 is described as a wireline downhole tool, it should be appreciated that any suitable conveyance may be used. For example, the downhole tool 12 may instead be conveyed as a logging-while-drilling (LWD) tool as part of a bottom hole assembly (BHA) of a drill string, conveyed on a slickline or via coiled tubing, and so forth. For the purposes of this disclosure, the downhole tool 12 may be any suitable downhole tool that uses a mixer to produce an alloy product for sealing within the wellbore 16 in the subterranean reservoir environment.

As discussed further below, the downhole tool 12 may deploy separate reactants within a mixer to produce a liquid or partially liquid alloy product (e.g., alloy with intermetallic compounds, such as an amalgam or amalgam-like alloy) that hardens into a solid alloy product within the subterranean reservoir environment 38. The mixer may receive energy from an electrical energy device and/or an electrical energy storage device, such as the auxiliary power source 24 or another electrical energy source, to mix the reactants and produce the liquid or partially liquid alloy product. Additionally, in some embodiments, the downhole tool 12 may include a power source within the downhole tool 12, such as a battery system or a capacitor to store sufficient electrical energy to power the mixer. The mixer may produce and solidify the liquid or partially liquid alloy product such as an alloy with intermetallic compounds, such as an amalgam or an amalgam-like alloy used to seal various subterranean elements, such as tubing and casing components, tubing and casing components having cracks and/or corrosion holes, connection leaks, casting-to-tubing spaces (e.g., above thread connections), tool ports, tool internal passageways no longer functionally in need, and porous geological formations (e.g., especially when producing undesirable fluids such as water in high flow rates or water cuts). The mixer may utilize solid alloy products for other downhole tasks as well.

Control signals 25 may be transmitted from a data processing system 28 to the downhole tool 12 to activate the mixer within the downhole tool 12. Additionally, data related to the actions of the mixer may be detected by the downhole tool 12 as data 26 relating the mixer. For example, the data 26 may include an amount of time the mixer is operating, an amount of power used by the mixer, an amount of reactants used by the mixer, an amount of liquid or partially liquid alloy product produced by the mixer, an amount of time until the liquid or partially liquid alloy product has hardened into the solid alloy product, or other parameters related to the mixer. The data 26 may be sent to the data processing system 28. The data processing system 28 may be any electronic data processing system that can be used to carry out the systems and methods of this disclosure. For example, the data processing system 28 may include a processor 30, which may execute instructions stored in memory 32 and/or storage 34. As such, the memory 32 and/or the storage 34 of the data processing system 28 may be any suitable article of manufacture that can store the instructions. The memory 32 and/or the storage 34 may be read-only memory (ROM), random-access memory (RAM), flash memory, an optical storage medium, or a hard disk drive, to name a few examples. A display 36, which may be any suitable electronic display, may display images generated by the processor 30. The data processing system 28 may be a local component of the logging winch system 20 (e.g., within the downhole tool 12), a remote device that analyzes data from other logging winch systems 20, a device located proximate to the drilling operation, or any combination thereof. In some embodiments, the data processing system 28 may be a mobile computing device (e.g., tablet, smart phone, smart glasses, or laptop) or a server remote from the logging winch system 20.

Figure 2:
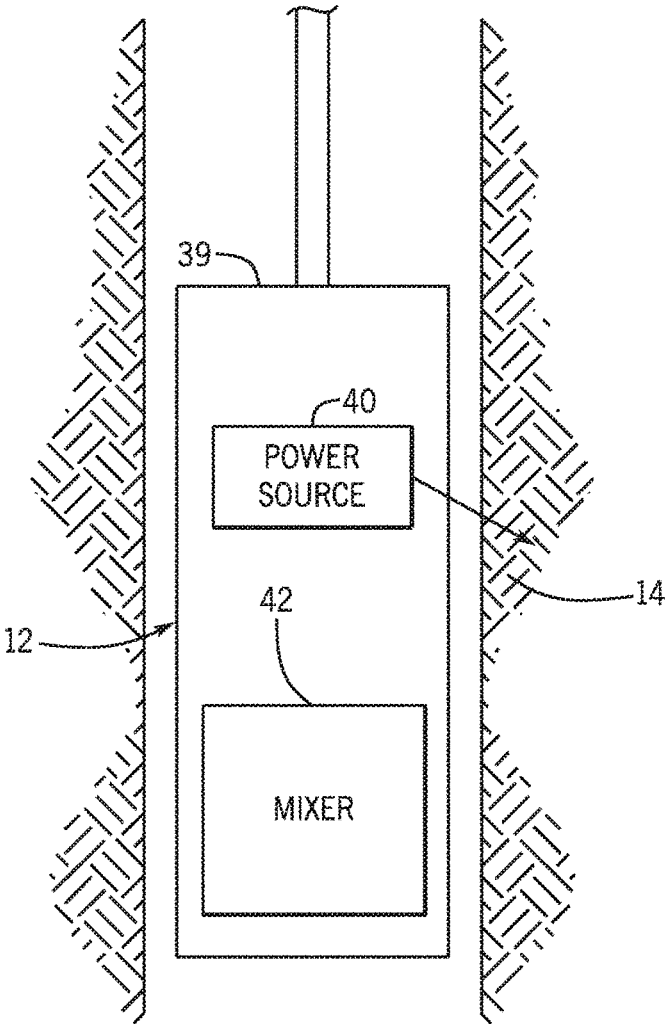
FIG. 2 is a block diagram of the downhole tool of FIG. 1 that includes a mixer for producing the liquid or partially liquid alloy product, in accordance with an embodiment.

FIG. 2 is a block diagram of the downhole tool 12 that produces alloy product for sealing various elements in a subterranean reservoir environment 38. The subterranean reservoir environment 38 may generally include the geological formation 14 and/or the wellbore 16. Within a housing 39, the downhole tool 12 may include a power source 40, such as a battery, a connection to the auxiliary power source 24 of FIG. 1, or another suitable power source. The downhole tool 12 may also include a mixer 42 for producing an alloy product via a mixing chamber, a grinder portion, a shaker portion, a chiller portion, and/or a heating element. The downhole tool 12 may employ the mixer 42 to produce the alloy product for sealing various subterranean elements, such as tubing and casing components, tubing and casing components having cracks and/or corrosion holes, connection leaks, casting-to-tubing spaces (e.g., above thread connections), tool ports, tool internal passageways no longer functionally in need, and porous geological formations (e.g., especially when producing undesirable fluids such as water in high flow rates or water cuts). In some embodiments, the mixer 42 produces a liquid or partially liquid alloy product that rapidly solidifies within the subterranean reservoir environment 38. Indeed, solidification of the liquid or partially liquid alloy product may occur within a time threshold typically on the order of minutes.

Figure 3:
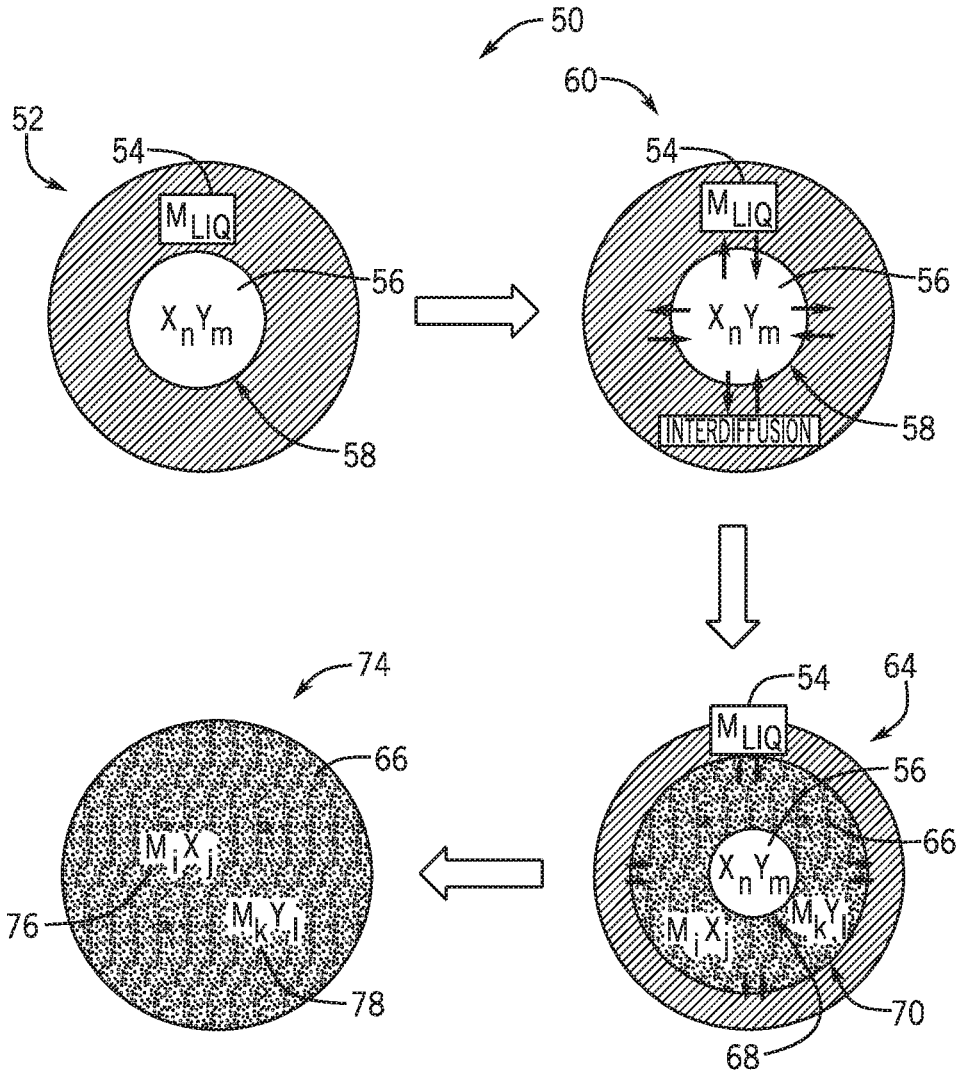
FIG. 3 is a schematic diagram of metallurgical reactions employed by the mixer of FIG. 2 to produce the liquid or partially liquid alloy product, in accordance with an embodiment.

FIG. 3 is a schematic diagram of metallurgical reactions 50 (e.g., diffusion-controlled reactions) enabled by the mixer 42 in the downhole device 12 to produce the liquid or partially liquid product. For example, the mixer 42 may deploy and mix reactants within a mixing portion of the mixer 42 to form the liquid or partially liquid alloy product for use within the subterranean reservoir environment 38. It is to be understood that other reactants, products, or components of the metallurgical reactions 50, including any suitable catalysts and byproducts of the metallurgical reactions 50, may also be present. Indeed, the metallurgical reactions 50 of FIG. 3 are intended merely as an example of metallurgical reactions. In a simplified form, a generalized example of metallurgical reactions, including the metallurgical reactions 50, may be represented by Equation 1 below:

$$M_{(Liquid)}+X_nY_m=M_iX_j+M_kY_j+(X,Y)_{residual} \quad (1)$$

in which $M_{(Liquid)}$ is a fusible metal reactant in liquid form (e.g., precursor metal or precursor alloy) and $X_nY_m$ is a solid metal or semi-metal reactant in which n and m represent atomic ratios of the elements within the solid metal or semi-metal reactant. In some embodiments, the fusible metal M may be an alloy including more than one metal or semi-metal element. The solid metal or semi-metal reactant $X_nY_m$ is an alloy composed of a metal or semi-metal X and a metal or semi-metal Y. Indeed, the solid metal or semi-metal reactant $X_nY_m$ may include multiple different elements each having different ratios of X and Y. In some embodiments, much of or at least a portion of the solid metal or semi-metal reactant $X_nY_m$ may have continuously variable proportions of X and Y.

An example of a metallurgical reaction according to Equation 1 is represented by Equation 2 below:

$$Hg_{(Liquid)}+Ag_3Sn_{(Solid)}=Hg_4Ag_{3(Solid)}+Sn_{(Solid)} \quad (2)$$

in which the products $Hg_4Ag_3$ and Sn within a liquid or partially liquid alloy may solidify within a subterranean reservoir environment within minutes. Utilizing reactants that are in a finely fragmented form (i.e., particulates and powders more so than coarser shots or pellets) may also increase the rate of the metallurgical reactions and the rate of solidification of a resulting liquid or partially liquid alloy product. Another metallurgical reaction may be represented by Equation 3 below, an example of which is shown in Equation 4 below:

$$M_{(Liquid)}+X=M_iX_j+M_kX_l+(X,Y)_{residual} \quad (3)$$

$$Ga_{(Liquid)}+CU_{(Solid)}=GaCu_{2(Solid)} \quad (4)$$

in which suffixes i, j, k and l designate various atomic ratios.

As shown by Equation 1, which is also applicable to Equation 2, a portion of the metal reactant M may replace the X and/or the Y of the solid metal or semi-metal reactant $X_nY_m$ to form intermetallic compounds $M_iX_j$ and $M_kY_j$. Any residual X and Y then remains as a separate element phase, or alternatively forms a byproduct alloy, $(X,Y)_{residual}$. Although not included in Equations 1 and 3, metal reactant M may also remain in excess. The intermetallic compounds $M_iX_j$ and $M_kY_j$ and the byproduct alloy $(X,Y)_{residual}$ together may form the alloy product discussed above. Further, the intermetallic compounds $M_iX_j$ and $M_kY_j$ may include definite proportions of the metal reactant M, the metal or semi-metal X, and the metal or semi-metal Y. Accordingly, the intermetallic compounds $M_iX_j$ and $M_kY_j$ may be advantageously solidified (e.g., crystallized) in the subterranean reservoir environment 38 to seal various subterranean elements. As such, the intermetallic compounds $M_iX_j$ and $M_kY_j$ may have melting temperatures that are above an ambient temperature of the subterranean reservoir environment.

Now looking to a first stage 52 of the metallurgical reactions 50, a liquid metal reactant 54 and a solid metal or semi-metal reactant 56 are placed in contact with one another. The liquid metal reactant 54 may be similar to the metal reactant M of Equation 1 and the solid metal or semi-metal reactant 56 may be similar to the solid metal or semi-metal reactant $X_nY_m$ of Equation 1. The liquid metal reactant 54 may be melted within the subterranean reservoir environment 38 or may be melted before being placed within the subterranean reservoir environment 38. The liquid metal reactant 54 may include gallium, mercury, indium, tin, bismuth, lead, antimony, zinc, copper, or other metal reactants having or combined to have eutectic points (e.g., melting temperatures at specific pressures) below a temperature threshold, such as 100° C., 150° C., 200° C., 250° C., or 300° C. at 1 atm. In some embodiments, the liquid metal reactant 54 possesses a melting temperature that is below a temperature of the subterranean reservoir environment 38 or within a threshold range of a temperature of the subterranean reservoir environment. By having eutectic points below the temperature threshold, the liquid metal reactant 54 may be more readily prepared from solid metal reactants for use within the metallurgical reactions 50. A further, non-limiting list of metal reactants 45 having relatively low melting temperatures may be seen in Table 1 below. As shown, alloys of various metals may be employed as the liquid metal reactant 54.

TABLE 1

Examples of Metal Reactants having Low-Temperature Liquids.

| Chemical composition (% Element) | Liquidus, solidus, or eutectic temperature (Melting point) [° C.] |
|---|---|
| 49Bi—21In—18Pb—12Sn | 58 |
| 57Bi—26In—17Sn | 79 |
| 46Bi—34Sn—20Pb | 100 |
| 52In—48Sn | 118 |
| 58Bi—42Pb | 124 |
| 58Bi—42Sn | 138 |
| 100In | 156.7 |
| 70Sn—18Pb—12In | 162 |
| 62.5Sn—36.1Pb—1.4Ag | 179 |
| 63Sn—37Pb | 183 |
| 91Sn—9Zn | 199 |
| 95.6Sn—3.5Ag—0.9Cu | 217 |
| 100Sn | 231.9 |
| 65Sn—25Ag—10Sb | 233 |
| 66Pb—32Sn | 253 |
| 100Bi | 271 |

The solid metal or semi-metal reactant 56 may be any alloy suitable for combining with the liquid metal reactant 54. For example, the solid metal or semi-metal reactant 56 may be or include intermetallic compounds such as $Ag_3Sn$, SbSn, InSb, BiSn, CdSb, SbZn, $Sb_2Sn_3$, $Cu_2Sb$, $Cu_{10}Sb_3$, $Ga_2Cu$, or other suitable compounds found in binary, ternary, and more complex phase diagrams involving the herein listed chemical elements and compounds.

In the mixer, the solid metal or semi-metal reactant 56 may include a plurality of reactants, each having different ratios of elements. In some embodiments, much of or a portion of the solid metal or semi-metal reactant 56 may have continuously variable proportions of elements. In some embodiments, the solid metal or semi-metal reactant 56 may be selected or modified such that an average particle size of the solid metal or semi-metal reactant 56 is below a threshold particle size. By having an average particle size below the threshold particle size, the solid metallurgical reactant may have a greater exposed surface area to assist in the metallurgical reactions 50.

For ease of discussion, as shown in the first stage 52, an interface 58 exists between the liquid metal reactant 54 and the solid metal or semi-metal reactant 56. Specifically the interface 58 is shown as a discrete boundary, while in some embodiments, the interface 58 includes a diffused boundary layer with internal compositional gradients. In some embodiments, the interface 58 is generally arcuate or circular, as shown. In some embodiments, the interface 58 between the liquid metal reactant 54 and the solid metal or semi-metal reactant 56 may have a more irregular shape than the shape shown and may be more diffused, this exhibiting a transition layer, as opposed to the thin and distinct boundary schematically shown in the first stage 52 of the metallurgical reactions 50. The interface 58 may be formed when the liquid metal reactant 54 and the solid metal or semi-metal reactant 56 are mixed together to form a mixture of the liquid metal reactant 54 and the solid metal or semi-metal reactant 56. The more mixed the liquid metal reactant 54 and the solid metal or semi-metal reactant 56 are, the smaller the interface 58 may be for a given mixing time. In this manner, a larger quantity of the smaller interfaces 58 may be present, such that a greater surface area of the liquid metal reactant 54 is in contact with the surface area of the solid metal or semi-metal reactant 56. Further, the interface 58 may be considered a boundary of a reaction zone in which the metallurgical reactions 50 will occur.

Looking to a second stage 60 of the metallurgical reactions 50, the interface 58 begins to expand as the liquid metal reactant 54 and the solid metal or semi-metal reactant 56 metallurgically interact. By a metallurgical process of thermally-activated atomic interdiffusion, atoms of the liquid metal reactant 54 exchange across the interface 58 with elements of the solid metal or semi-metal reactant 56, in accordance with Equation 1. This atomic interaction may be possible with the liquid metal reactant 54 in the liquid phase, such that the liquid metal reactant 54 may easily move. In some embodiments, the solid metal or semi-metal reactant 56 may also be in the liquid phase.

Now looking to a third stage 64 of the metallurgical reactions 50, an alloy product 66 (e.g., alloy with intermetallic compounds, such as an amalgam or amalgam-like alloy) is produced between the liquid metal reactant 54 and the solid metal or semi-metal reactant 56. The alloy product 66 may be formed when the atoms of the liquid metal reactant 54 and the atoms of the solid metal or semi-metal reactant 56 contact each other during the atomic interdiffusion. A first interface 68 may therefore exist between the alloy product 66 and the solid metal or semi-metal reactant 56. Additionally, a second interface 70 may exist between the alloy product 66 and the liquid metal reactant 54. Interactions between the liquid metal reactant 54 and the solid metal or semi-metal reactant 56 may continue across the first interface 68 and/or the second interface 70. In some embodiments, the liquid metal reactant 54 has a specific gravity that is within 20% of the specific gravity of the solid metal or semi-metal reactant 56. In some embodiments, the alloy product 66 has a specific gravity that is within 20% of the specific gravity of a mixture of the liquid metal reactant 54 and the solid metal or semi-metal reactant 56 at the first interface 68 and/or the second interface 70.

As the metallurgical reactions 50 continue to a fourth stage 74, the alloy product 66 may proceed to occupy the space previously occupied by the liquid metal reactant 54 and the solid metal or semi-metal reactant 56. In this manner, the liquid metal reactant 54 and the solid metal or semi-metal reactant 56 have reacted to form the alloy product 66.

The alloy product 66 may be a liquid or partially liquid that is readily solidified and/or crystallized within the subterranean reservoir environment 38. Additionally, the alloy product 66 may include more than one intermetallic compounds, such as the first intermetallic compound 76 and the second intermetallic compound 78 shown within the third stage 64 and the fourth stage 74 of the metallurgical reactions 50. The intermetallic compounds 76, 78 may be readily organized into crystals of various morphologies by transferring thermal energy to the subterranean reservoir environment 38 and/or to a chiller of the mixer 42. Additionally, it is to be understood that the intermetallic compounds 76, 78 and the solid metal or semi-metal reactant 56 are shown as binary chemicals merely for ease of discussion. Accordingly, reactants having three or more elements may also be employed by the mixer 42 discussed herein. Additionally, catalyst may be included within the mixer 42 to enhance the rate at which the metallurgical reactions 50 proceed.

Further, examples of the liquid metal reactant 54 (e.g., fusible metal components) that may be present in the liquid or partially-liquid state prior to entering the mixer may include gallium (Ga) and/or mercury (Hg), which are both liquid at normal subterranean temperatures. Examples of solid metal or semi-metal reactant 56 with higher melting temperature, normally solid when entering the mixer, may include silver, tin, copper, and zinc. Upon being thoroughly mixed in suitable proportion (e.g. 41% Ag, 4% Hg, 26% Sn, 22% Cu, and 7% Zn), the resulting liquid or partially liquid alloy product 66 solidifies over time, reaching useful strength within hours. Another exemplary and simple composition may include pure gallium as the liquid metal reactant 54, while the solid metal or semi-metal reactant 56 may include copper and tin. The liquid metal component and the solid metal or semi-metal reactant 56 may also be thoroughly mixed in suitable proportion (e.g., 38 wt. % Ga, 27 wt. % Sn, and 36 wt. % Cu) to form the liquid or partially liquid alloy product 66. Upon proper mixing of the solid metal or semi-metal reactant 56 (e.g., in the form of a powder) with liquid the liquid metal reactant 54, both compositions disclosed herein may form the solid alloy products 66 within minutes, and within 24 hours produces yield strength in excess of 30 ksi, well suitable for subterranean sealing applications.

Figure 4:
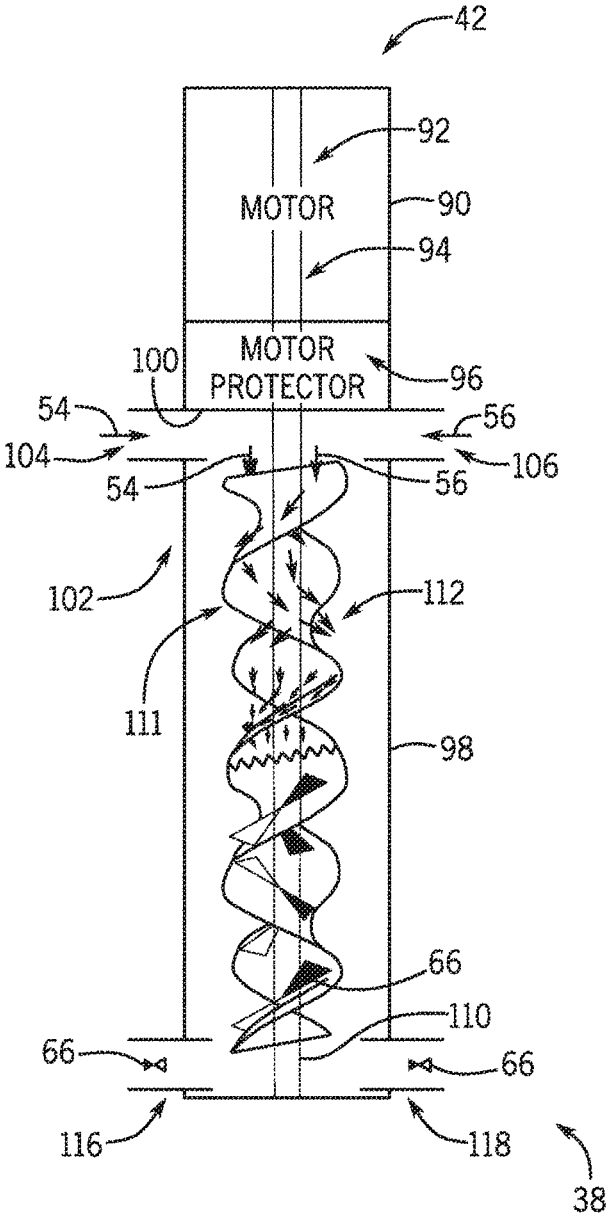
FIG. 4 is a schematic diagram of the mixer of FIG. 2 to apply seals in the subterranean reservoir environment, in accordance with an embodiment.

FIG. 4 is a schematic diagram of a mixer 42 that may be employed within a downhole tool 12 for applying seals in the subterranean reservoir environment 38. It is to be understood that the relative locations of components of the mixer 42 are merely exemplary, such that mixers of other shapes and/or other components may also be employed.

As shown, the mixer 42 has an outer housing 90 disposed around several components of the mixer 42. Within the outer housing 90, the mixer 42 may include a motor 92. The motor 92 may receive power from any suitable power source, such as the power source 40 within the downhole tool 12. Based on selective receipt of the power from the power source 40, the motor 92 may rotate a shaft 94 within the housing 90.

In some embodiments, the shaft 94 may extend through a motor protector 96 and into an inner housing 98 of the mixer 42. In some embodiments, the motor protector 96 may be an annular sealing element to sealingly separate the motor 92 from the inner housing 98. The motor protector 96 may include an opening through which the shaft 94 extends. Additionally, the motor protector 96 may include sealing elements, such as lip seals, labyrinth seals, or other seals along sides or the opening of the motor protector 96 to fluidly separate the motor 92 from the inner housing 98. Further, a bottom surface 100 of the motor protector 96 may define an upper end 102 of the inner housing 98 of the mixer 42. In some embodiments, the inner housing 98 may share walls, such as annular walls of the inner housing 98, with the outer housing 90.

In the upper end 102 of the inner housing 98, the mixer 42 may receive reactants through a first inlet 104 and/or a second inlet 106. For example, the liquid metal reactant 54 may be added to the inner housing 98 through the first inlet 104 and the solid metal or semi-metal reactant 56 may be added to the inner housing 98 through the second inlet 106. In some embodiments, the mixer 42 may include one inlet by which both the liquid metal reactant 54 and the solid metal or semi-metal reactant 56 are added to the inner housing 98.

The downhole tool 12 may include a storage portion to hold the reactants 54, 56. The storage portion may be a receptacle fluidly coupled to the first inlet 104 and/or the second inlet 106. In some embodiments, the storage portion may include a first receptacle to hold the liquid metal reactant 54 and a second receptacle to hold the solid metal or semi-metal reactant 56. The liquid metal reactant 54 may be stored as a liquid material within the first receptacle. Additionally, the solid metal or semi-metal reactant 56 may be stored as a solid material, such as pellets, capsules, flakes, or powder within the second receptacle. The reactants 54, 56 may be moved from the storage portion through the inlets 104, 106 via selective actuation of a valve, a pressure release, a conveyer belt, or another suitable device for transferring liquid reactants and/or solid reactants within the downhole tool 12.

Additionally, a mixing chamber 111 may be disposed within the inner housing 98 of the mixer 42. For example, a portion 110 of the shaft 94 extending through the motor protector 96 may include one or more impellers 112 (e.g., mixing impellers) that combine the reactants 54, 56 added to the mixer 42. For ease of discussion, impellers described herein may refer to a single impeller or a number of impellers organized into stages (e.g., analogous to stacked up stages in oilfield electrosubmersible pumps). Those skilled in the art may further understand that an impeller may refer to a paddle blade, a ribbon blade, a turbine vortex blade, a turbine-like blade, an umbrella type blade, a flat blade, an anchor blade, a spiral blade, a Ruvastar cyclo dispersing blade, an open blade, among other impellers found in industrial mixers or blenders.

Additionally, in some embodiments, the impellers 112 may draw (e.g., pull) more of the reactants 54, 56 within the inlets 104, 106 as the impellers 112 rotate. During mixing within the mixing chamber 111, the reactants may interdiffuse and undergo the intermetallic reactions 50 of FIG. 3 to form the liquid or partially liquid alloy product 66. In some embodiments, the mixing chamber 111 may shake or vibrate the reactants 54, 56. For example, the shaft 94 may selectively vibrate up and down to jostle the reactants 94 while mixing continues.

In some embodiments, much of or a portion of the impellers 112 may include heating elements (e.g., heater, electrically powered resistive and/or inductive heating elements, fluidly heated elements) for adding thermal energy to the reactants 54, 56 within the mixer 42. For example, if the metal product 54 is provided through the inlet 104 as a solid material, the impellers 112 having the heating elements may melt (e.g., liquefy) the solid material into a liquid material while simultaneously mixing the reactants 54, 56 together. Additionally, the mixer 42 may include a heating device disposed outside the housing 90 of the mixer 42. The heating device may be ignited thermite or a heat exchanger for providing thermal energy to one or both of the reactants 54, 56 before the reactants 54, 56 enter the mixing portion of the inner housing 98.

As the reactants 54, 56 are mixed by the impellers 112 to form the liquid or partially liquid alloy product 66, the reactants 54, 56 and the liquid or partially liquid alloy product 66 may continue downward through the inner housing 98 of the mixer 42. Eventually, much of or a portion of the reactants 54, 56 may react to form the liquid or partially liquid alloy product 66. The liquid or partially liquid alloy product 66 may then proceed to discharge from the mixer 42 via a first outlet 116 and a second outlet 118 of the inner housing 98 of the mixer 42. In some embodiments, the mixer 42 may include one outlet by which the liquid or partially liquid alloy product 66 exits the mixer 42.

Within the subterranean reservoir environment 38, the liquid or partially liquid alloy product 66 may be applied to various elements. Then, the liquid or partially liquid alloy product 66 may cool to form the solid alloy product 66. Once cooled, the solid alloy product 66 includes intermetallic compounds having high melting temperatures. In this manner, the solid alloy product 66 may desirably seal various subterranean elements, such as tubing and casing components, tubing and casing components having cracks and/or corrosion holes, connection leaks, casting-to-tubing spaces (e.g., above thread connections), tool ports, tool internal passageways no longer functionally in need, and porous geological formations (e.g., especially when producing undesirable fluids such as water in high flow rates or water cuts).

Figure 5:
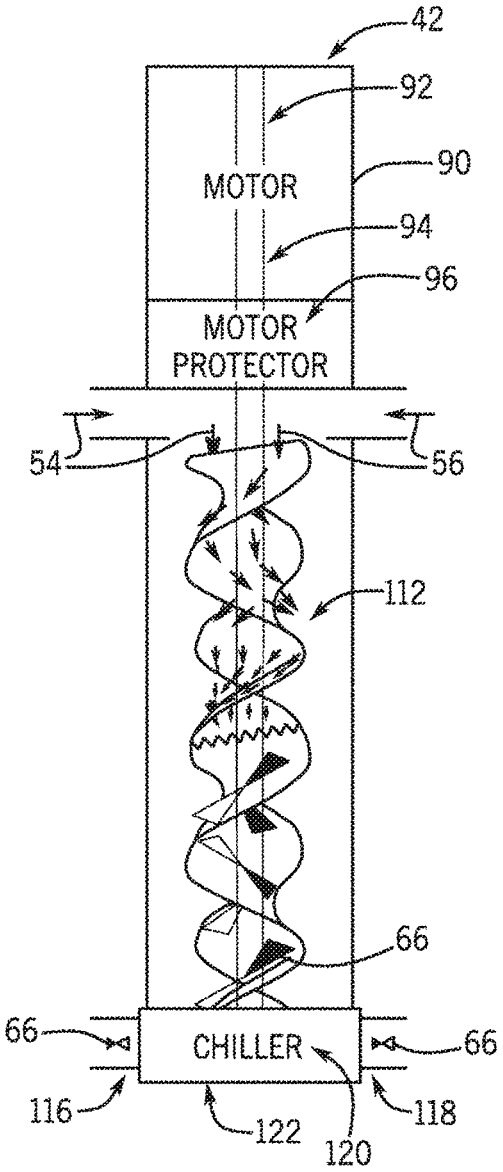
FIG. 5 is a schematic diagram of the mixer of FIG. 4, further including a chiller portion, in accordance with an embodiment.

FIG. 5 is a schematic diagram of the mixer 42 of FIG. 4, further including a chiller portion 120 (e.g., chiller) disposed adjacent the outlets 116, 118. The chiller portion 120 may be any suitable device for removing thermal energy from the liquid or partially liquid alloy product 66. Indeed, the chiller portion may be a heat exchanger and/or a chilled portion of the impellers 112. In some embodiments, the chiller portion 120 removes thermal energy from the liquid or partially liquid alloy product 66 before the liquid or partially liquid alloy product 66 discharges from the mixer 42. In some embodiments, the chiller portion 120 may alternatively or additionally chill the liquid or partially liquid alloy product 66 after the liquid or partially liquid alloy product 66 has been discharged through the outlets 116, 118 via a chilling device. By including the chiller portion 120 at a longitudinal end 122 of the inner housing 98, the mixer 42 may discharge liquid or partially liquid alloy product 66 into the subterranean reservoir environment 38 that may be more rapidly solidified. As such, removing thermal energy from the liquid or partially liquid alloy product 66 permits the intermetallic components within the liquid or partially liquid alloy product 66 to crystallize more readily into the desired solid state for sealing various subterranean elements.

Figure 6:
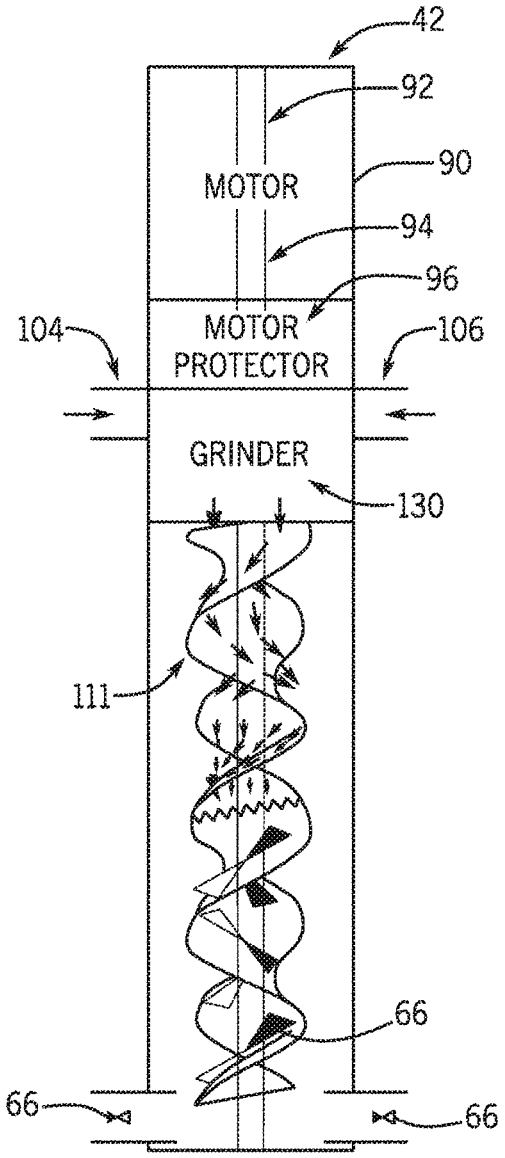
FIG. 6 is a schematic diagram of the mixer of FIG. 4, further including a grinder portion, in accordance with an embodiment.

FIG. 6 is a schematic diagram of the mixer of FIG. 4, further including a grinder portion 130 (e.g., grinder) disposed adjacent the inlets 104, 106. The grinder portion 130 may include specialized impellers actuated by rotation of the shaft 94, a crushing device, or other suitable equipment for grinding, crushing, and/or fragmenting reactants within the mixer 42. For example, the solid metal or semi-metal reactant 56 may be ground by the grinder portion 130 into smaller particles, such as particulates or powders. As such, inclusion of the grinder portion 130 permits the mixer 42 to employ solid metal or semi-metal reactant 56 having larger particles. The larger particles may be capsules, pellets, shots, flakes, or random chunks of the solid metal or semi-metal reactant 56 that are ground into the dust and/or powders. In addition, the grinder portion 130 may be separate from the mixing chamber 111. That is, the reactants 54, 56 may be ground within the grinder portion 130 before the reactants 54, 56 are mixed in the mixing chamber 111. However, the heating elements may be included within the impellers 112 within the grinder portion 130, the mixing chamber 111, or both.

Figure 7:
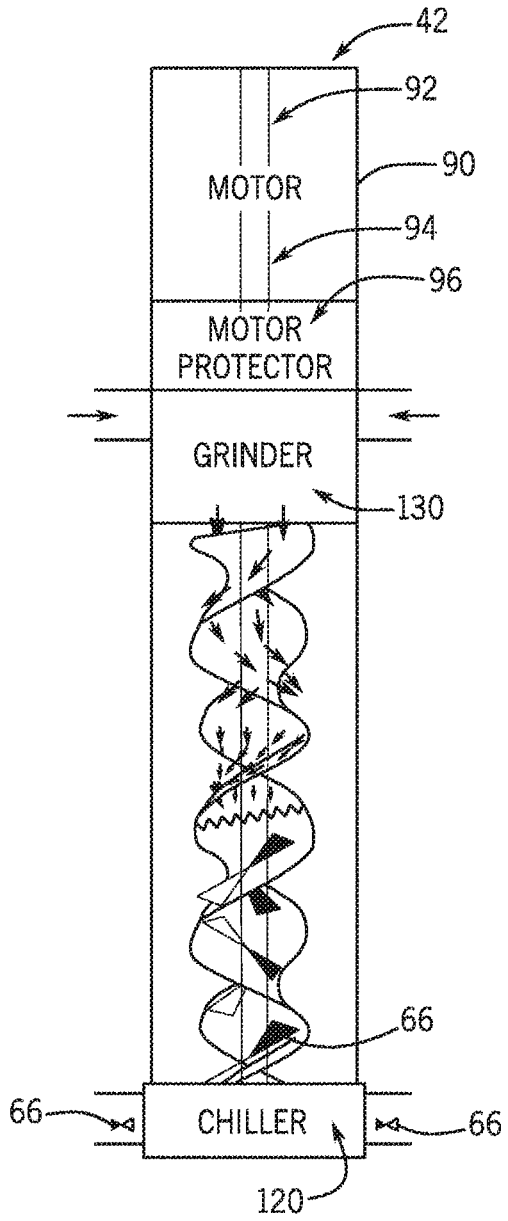
FIG. 7 is a schematic diagram of the mixer of FIG. 4, further including the chiller portion of FIG. 5 and the grinder portion of FIG. 6, in accordance with an embodiment.

FIG. 7 is a schematic diagram of the mixer of FIG. 4, further including the chiller portion 120 of FIG. 5 and the grinder portion 130 of FIG. 6. In embodiments having the chiller portion 120 and the grinder portion 130, the reactants 54, 56 added to the mixer 42 may first be ground into smaller particles within the grinder portion 130. Then, the ground reactants 54, 56 may continue to the mixing chamber 111, in which the metallurgical reactions 50 of FIG. 30 proceed and generate the liquid or partially liquid alloy product 66. Then, the liquid or partially liquid alloy product 66 continues through the chiller portion 120. In the chiller portion 120, the liquid or partially liquid alloy product 66 may release thermal energy to the chiller portion 120. Accordingly, the liquid or partially liquid alloy product 66 discharged through the outlets 116, 118 may rapidly solidify into the solid alloy product 66.

Figure 8:
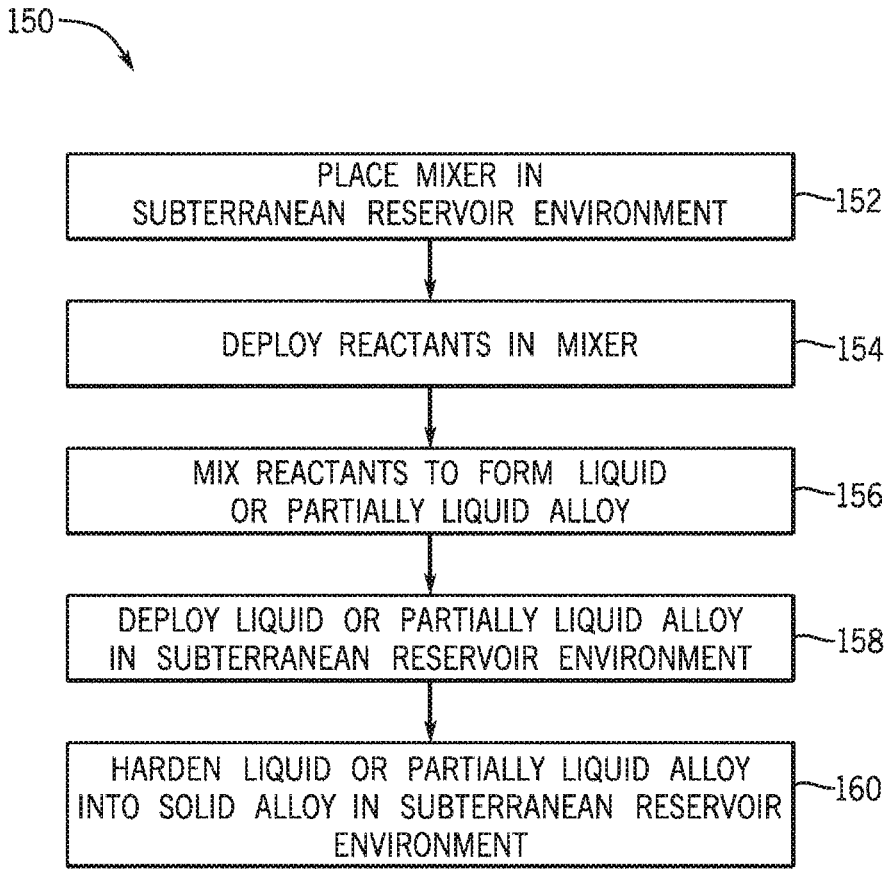
FIG. 8 is a flowchart of a method for employing the mixer of FIG. 4 to produce the liquid or partially liquid alloy product for use in the subterranean reservoir environment, in accordance with an embodiment.

The above-described mixer 42 may include one or more devices to produce the solid alloy product 66, some of which are described in relation to the generation of the solid alloy product 66 below. FIG. 8 is a flowchart of a method 150 for deploying the liquid or partially liquid alloy product 66 into the subterranean reservoir environment 38 for forming seals, in accordance with an embodiment. The method 150 may be performed, for example, by the mixer 42 of FIG. 4. Although the following description of the method 150 is described as being performed by the downhole tool 12 including the mixer 42 of FIG. 4, it should be noted that the method 150 may be performed by any suitable downhole tool or mixer. Moreover, although the method 150 is described as being performed in a particular order, it should be understood that the method 150 may be performed in any suitable order and is not limited to the order presented herein.

Referring now to FIG. 8, at block 152, the downhole tool 12 may place the mixer 42 in the subterranean reservoir environment 38. The downhole tool 12 may include the power source 40 to power components of the mixer 42. In some embodiments, the downhole tool 12 includes actuators to manipulate the mixer 42 within the downhole tool or within the subterranean reservoir environment 38. Additionally, in embodiments in which the mixer 42 shares walls with the downhole tool 12, placing the downhole tool 12 within the subterranean reservoir environment 38 may therefore place the mixer 42 within the subterranean reservoir environment 38. In some embodiments, the downhole tool 12 may use the mixer 42 to produce the liquid or partially liquid alloy product 66 within the housing 39 of the downhole 12.

At block 154, the mixer 42 may deploy the reactants, such as the liquid metal reactant 54 and the solid metal or semi-metal reactant 56, within the mixer 42. In some embodiments, the mixer 42 includes an inlet 104 for the liquid metal reactant 54 and an inlet 106 for the solid metal or semi-metal reactant 56. The mixer 42 may retain the reactants 54, 56 within separate containers disposed inside the downhole tool 12. Then, when activated, the reactants 54, 56 may be added via the inlets 104, 106 into the inner housing 98 (e.g., mixing chamber) of the mixer 42. In some embodiments, the liquid metal reactant 54 may be provided to the mixer 42 as a solid material, which is then melted by a heated element of the mixer 42.

At block 156, the mixer 42 may mix the reactants 54, 56 to form the liquid or partially liquid alloy product 66. The reactants 54, 56 may be mixed by the impeller 112 that extends through at least a portion of the inner housing 98 of the mixer 42. The liquid or partially liquid alloy product 66 is the product of metallurgical reactions 50 described above with reference to FIG. 3. For example, the liquid metal reactant 54 and the solid metal or semi-metal reactant 56 may interdiffuse, and then undergo the metallurgical reactions 50 to form the liquid or partially liquid alloy product 66. In some embodiments, the liquid or partially liquid alloy product 66 includes one or more intermetallic compounds having high melting temperatures.

At block 158, the mixer may deploy the liquid or partially liquid alloy product 66 within the subterranean reservoir environment 38. The mixer 42 may deploy the liquid or partially liquid alloy product 66 via the outlets 116, 118 of the mixer 42. Indeed, the downhole tool 12 may adjust the position of the outlets 116, 118 such that the liquid or partially liquid alloy product 66 is applied to a component or zone in the subterranean reservoir environment 38 that would be desirably sealed, such as tubing and casing components, tubing and casing components having cracks and/or corrosion holes, connection leaks, casting-to-tubing spaces (e.g., above thread connections), tool ports, tool internal passageways no longer functionally in need, and porous geological formations (e.g., especially when producing undesirable fluids such as water in high flow rates or water cuts).

At block 160, the liquid or partially liquid alloy product 66 may solidify into a solid alloy. The liquid or partially liquid alloy product 66 may solidify by releasing thermal energy into the subterranean reservoir environment 38 or other components near the liquid or partially liquid alloy product 66, such as the downhole tool 12 or the mixer 42. The liquid or partially liquid alloy product 66 may therefore form one or more crystalline structures as the solidification proceeds to desirably seal subterranean elements.

Figure 9:
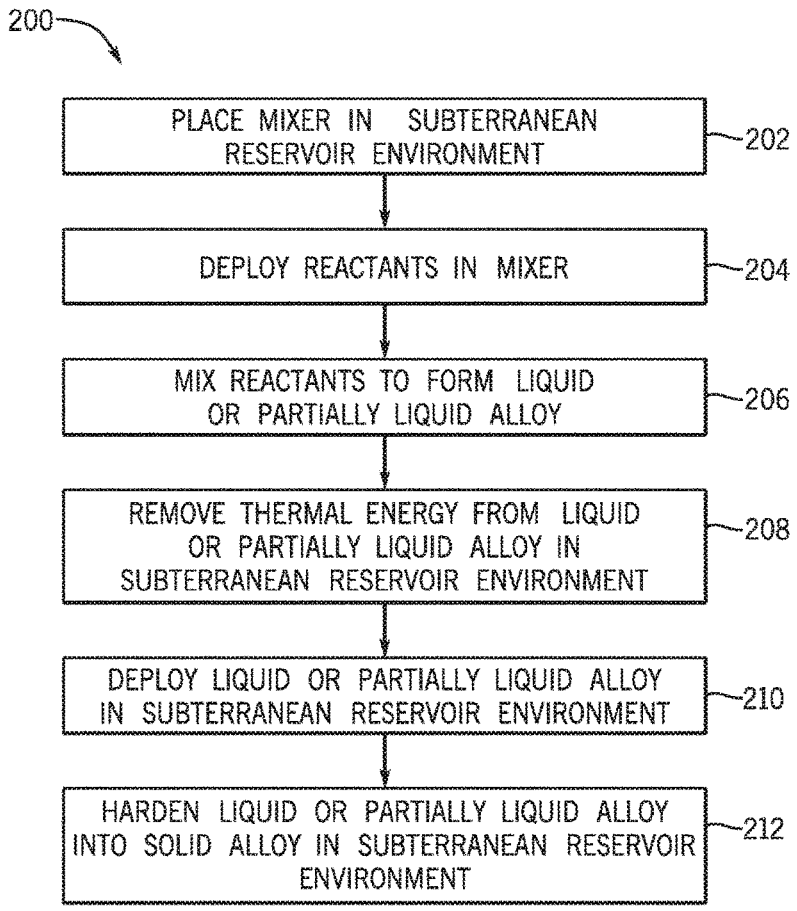
FIG. 9 is a flowchart of a method for employing the mixer of FIG. 5 to produce the liquid or partially liquid alloy product for use in the subterranean reservoir environment, in accordance with an embodiment.

FIG. 9 is a flowchart of a method 200 for deploying the liquid or partially liquid alloy product 66 into the subterranean reservoir environment 38 for forming seals, in accordance with an embodiment. The method 200 may be performed, for example, by the mixer 42 of FIG. 5. Although the following description of the method 200 is described as being performed by the downhole tool 12 including the mixer 42 of FIG. 5, it should be noted that the method 200 may be performed by any suitable downhole tool or mixer. Moreover, although the method 200 is described as being performed in a particular order, it should be understood that the method 200 may be performed in any suitable order and is not limited to the order presented herein. Further, it should be noted that block 202, block 204, block 206, block 210, and block 212 of the method 200 correspond respectively to block 152, block 154, block 156, block 158, and block 160 of method 150 of FIG. 8. That is, the blocks of the method 200 are similar to the blocks of the method 150 of FIG. 8, such that the liquid or partially liquid alloy product 66 may be produced, deployed in the subterranean reservoir environment 38, and solidified similarly by the method 200 as by the method 150 of FIG. 8.

However, in addition to the blocks of the method 150 of FIG. 8, at block 208, the mixer 42 may remove thermal energy from the liquid or partially liquid alloy product 66 before the liquid or partially liquid alloy product 66 is deployed in the subterranean reservoir environment 38. The thermal energy may be removed by a chiller portion 120 of the mixer 42, such as a chilled portion of the impellers 112 or by a heat exchanger of the mixer 42. By removing the thermal energy from the liquid or partially liquid alloy product 66, the liquid or partially liquid alloy product 66 may solidify more rapidly within the subterranean reservoir environment 38.

Figure 10:
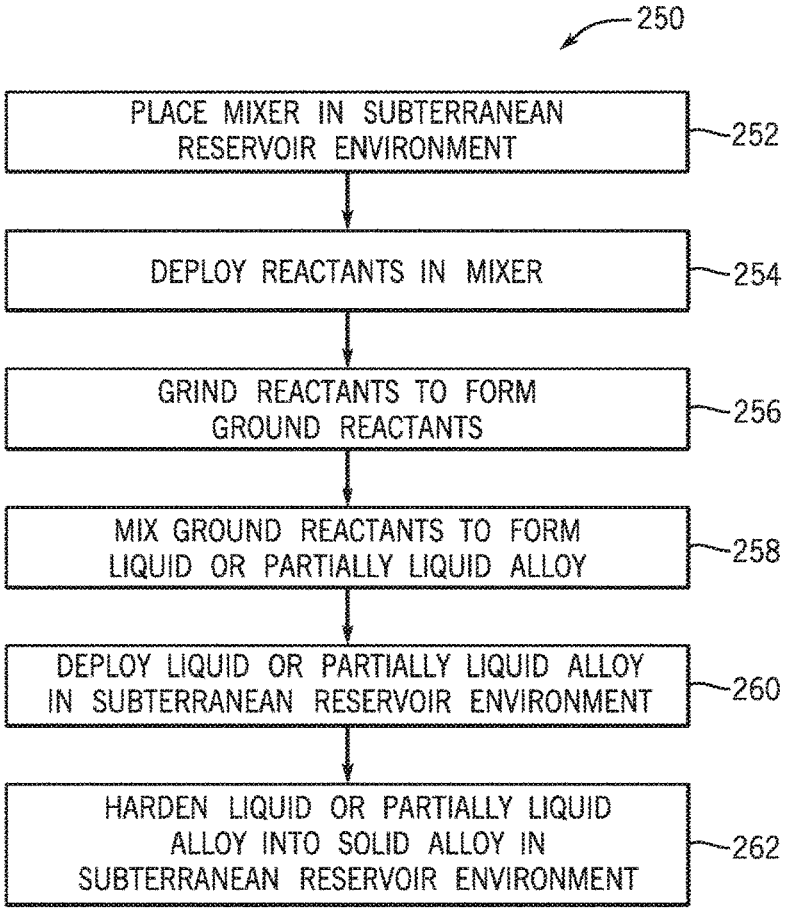
FIG. 10 is a flowchart of a method for employing the mixer of FIG. 6 to produce the liquid or partially liquid alloy product for use in the subterranean reservoir environment, in accordance with an embodiment.

FIG. 10 is a flowchart of a method 250 for deploying the liquid or partially liquid alloy product 66 into the subterranean reservoir environment 38 for forming seals, in accordance with an embodiment. The method 250 may be performed, for example, by the mixer 42 of FIG. 6. Although the following description of the method 250 is described as being performed by the downhole tool 12 including the mixer 42 of FIG. 6, it should be noted that the method 250 may be performed by any suitable downhole tool or mixer. Moreover, although the method 250 is described as being performed in a particular order, it should be understood that the method 250 may be performed in any suitable order and is not limited to the order presented herein. Further, it should be noted that block 252, block 254, block 258, block 260, and block 262 of the method 250 correspond respectively to block 152, block 154, block 156, block 158, and block 160 of method 150 of FIG. 8. That is, the blocks of the method 250 are similar to the blocks of the method 150 of FIG. 8, such that the liquid or partially liquid alloy product 66 may be produced, deployed in the subterranean reservoir environment 38, and solidified similarly by the method 250 as by the method 150 of FIG. 8.

However, in addition to the blocks of the method 150 of FIG. 8, at block 256, the mixer 42 may include a grinder portion 130 to fragment the reactants 54, 56. For example, the grinder portion 130 may reduce a particle size of the liquid metal reactant 54, the solid metal or semi-metal reactant 56, or both. In some embodiments, the grinder portion 130 is a specialized section of the impellers 112 for crushing and/or grinding the reactants 54, 56. By reducing a particle size of the reactants 54, 56, especially the solid metal or semi-metal reactant 56, a less expensive form of the reactants 54, 56 may be initially deployed within the mixer 42. For example, pellets, capsules, shots, chunks, or other large forms of the solid metal or semi-metal reactant 56 may be employed within the mixer 42.

Figure 11:
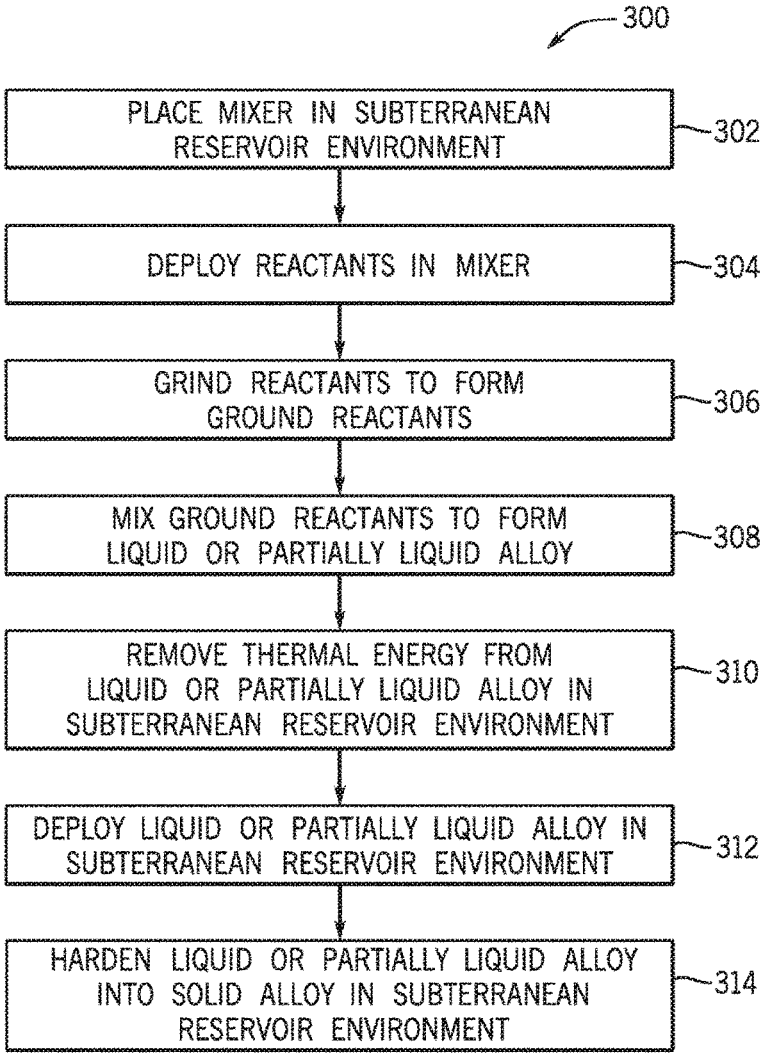
FIG. 11 is a flowchart of a method for employing the mixer of FIG. 7 to produce the liquid or partially liquid alloy product for use in the subterranean reservoir environment, in accordance with an embodiment.

FIG. 11 is a flowchart of a method 300 for deploying the liquid or partially liquid alloy product 66 into the subterranean reservoir environment 38 for forming seals, in accordance with an embodiment. The method 300 may be performed, for example, by the mixer 42 of FIG. 7. Although the following description of the method 300 is described as being performed by the downhole tool 12 including the mixer 42 of FIG. 7, it should be noted that the method 300 may be performed by any suitable downhole tool or mixer. Moreover, although the method 300 is described as being performed in a particular order, it should be understood that the method 300 may be performed in any suitable order and is not limited to the order presented herein. Further, it should be noted that block 302, block 304, block 308, block 312, and block 314 of the method 300 correspond respectively to block 152, block 154, block 156, block 158, and block 160 of method 150 of FIG. 8. That is, the blocks of the method 300 are similar to the blocks of the method 150 of FIG. 8, such that the liquid or partially liquid alloy product 66 may be produced, deployed in the subterranean reservoir environment 38, and solidified similarly by the method 300 as by the method 150 of FIG. 8.

Further, it should be noted that block 306 of the method 300 corresponds to block 256 of the method 250 of FIG. 10. Additionally, block 310 of the method 300 corresponds to block 208 of the method 200 of FIG. 9. In this manner, the method 300 includes, at block 306, fragmenting the reactants 54, 56 with the grinder portion 130 to form reactants 54, 56 having a smaller particle size. Additionally, at block 310, the mixer 42 removes thermal energy from the liquid or partially liquid alloy product 66 via the cooler portion 120. Accordingly, the liquid or partially liquid alloy product 66 may solidify or harden rapidly in the subterranean reservoir environment to desirably seal various subterranean elements, including parts of tools, tool strings, wellbores, and geological formations.

The specific embodiments described above have been shown by way of example, and it should be understood that these embodiments may be susceptible to various modifications and alternative forms. It should be further understood that the claims are not intended to be limited to the particular forms disclosed, but rather to cover modifications, equivalents, and alternatives falling within the spirit and scope of this disclosure.

The invention claimed is:

1. A downhole tool comprising:

a housing configured to be placed into a subterranean environment; and a mixer disposed in the housing, wherein the mixer comprises:

a first inlet configured to receive a fusible metal or alloy component;

a second inlet configured to receive a solid metal or semi-metal component;

a mixing chamber configured to mix the fusible metal or alloy component and the solid metal or semi-metal component to form a liquid or partially liquid alloy;

a shaft having an impeller configured to mix the fusible metal or alloy component and the solid metal or semi-metal component in the mixing chamber; and an outlet configured to discharge the liquid or partially liquid alloy into the subterranean environment, wherein the liquid or partially liquid alloy is configured to harden into a solid alloy over time.

2. The downhole tool of claim 1, comprising a heating device configured to provide thermal energy to the fusible metal or alloy component or the solid metal or semi-metal component, or both, before the fusible metal or alloy component or the solid metal or semi-metal component, or both, enter the mixing chamber, wherein the heating device is configured to ensure the fusible metal or alloy component is at least partially liquid in the mixing chamber.

3. The downhole tool of claim 1, comprising a crushing device configured to fragment the fusible metal or alloy component or the solid metal or semi-metal component, or both, before the fusible metal or alloy component or the solid metal or semi-metal component, or both, enter the mixing chamber.

4. The downhole tool of claim 1, comprising a cooling device configured to remove thermal energy from the liquid or partially liquid alloy before the liquid or partially liquid alloy exits the mixing chamber, after the liquid or partially liquid alloy exits the mixing chamber, or both.

5. The downhole tool of claim 1, wherein at least a portion of the impeller comprises a heating element configured to simultaneously add thermal energy and mix the fusible metal or alloy component and the solid metal or semi-metal component in the mixing chamber.

6. The downhole tool of claim 1, wherein the mixing chamber is configured to shake or vibrate to mix the fusible metal or alloy component and the solid metal or semi-metal component in the mixing chamber utilizing sonic technology, ultrasonic technology, piezoelectric technology, or a combination thereof.

7. The downhole tool of claim 1, comprising a first storage portion configured to store the fusible metal or alloy component and a second storage portion configured to store the solid metal or semi-metal component.

8. The downhole tool of claim 7, wherein the fusible metal or alloy component is stored in the first storage portion as a liquid material.

9. The downhole tool of claim 7, wherein the fusible metal or alloy component is stored in the first storage portion as a solid material.

10. The downhole tool of claim 9, wherein the fusible metal or alloy component is at least partially liquefied by a heater or a grinder before entering the mixing chamber.

11. The downhole tool of claim 1, wherein the fusible metal or alloy component is configured to be a liquid metal at a temperature lower than 250° C. and 1 atm.

12. A method comprising:

placing a downhole tool into a subterranean environment;

producing a liquid or partially liquid alloy via a mixer of the downhole tool by:

contacting a liquid fusible metal or alloy component with a solid metal or semi-metal component within the mixer;

mixing the liquid fusible metal or alloy component and the solid metal or semi-metal component to form the liquid or partially liquid alloy, wherein the liquid fusible metal or alloy component and the solid metal or semi-metal component react via metallurgical reactions that produce the liquid or partially liquid alloy; and discharging the liquid or partially liquid alloy into the subterranean environment, wherein the liquid or partially liquid alloy is configured to harden into a solid alloy over time.

13. The method of claim 12, wherein producing the liquid or partially liquid alloy via the mixer of the downhole tool comprises melting a solid fusible metal or alloy component via a heat source to form the liquid fusible metal or alloy component.

14. The method of claim 12, wherein producing the liquid or partially liquid alloy via the mixer of the downhole tool comprises fragmenting the solid metal or semi-metal component into a powder via a grinder of the mixer to reduce a particle size of the solid metal or semi-metal component.

15. The method of claim 12, wherein mixing the liquid fusible metal or alloy component and the solid metal or semi-metal component to form the liquid or partially liquid alloy comprises shaking or vibrating the liquid fusible metal or alloy component and the solid metal or semi-metal component in a mixing chamber of the mixer.

16. The method of claim 12, wherein producing the liquid or partially liquid alloy via the mixer of the downhole tool comprises cooling the liquid or partially liquid alloy via a cooler portion of the mixer or the downhole tool to reduce the time by which the liquid or partially liquid alloy is configured to harden into the solid alloy.

17. A downhole tool comprising:

a housing configured to be placed into a subterranean environment; and a mixer disposed in the housing, wherein the mixer comprises:

a first inlet configured to receive a fusible metal or alloy component, wherein the fusible metal or alloy component comprises an onset of melting temperature that is within a threshold range of a temperature of the subterranean environment;

a second inlet configured to receive a solid metal or semi-metal component, wherein the solid metal or semi-metal component comprises a particle size that is within a particle size threshold;

a mixing chamber configured to mix the fusible metal or alloy component and the solid metal or semi-metal component to form a liquid or partially liquid alloy, wherein the liquid or partially liquid alloy is a product of intermetallic reactions between a mixture of the fusible metal or alloy component and the solid metal or semi-metal component, and wherein a specific gravity of the fusible metal or alloy component and the solid metal or semi-metal component are within 20% from one another; and an outlet configured to discharge the liquid or partially liquid alloy into the subterranean environment, wherein the liquid or partially liquid alloy is configured to harden into a solid alloy over time.

18. The downhole tool of claim 17, wherein the fusible metal or alloy component comprises mercury, gallium, indium, tin, bismuth, lead, antimony, zinc, copper, or a combination thereof.

19. The downhole tool of claim 18, wherein the solid metal or semi-metal component comprises SbSn, InSb, BiSn, CdSb, SbZn, $Sb_2Sn_3$, $Cu_2Sb$, $Cu_{1o}Sb_3$or a combination thereof.

* * * * *